US011367999B2

(12) United States Patent
Deguchi

(10) Patent No.: US 11,367,999 B2
(45) Date of Patent: Jun. 21, 2022

(54) SPARK PLUG AND METHOD OF PRODUCING CENTRAL ELECTRODE THEREOF

(71) Applicant: DENSO CORPORATION, Kariya (JP)

(72) Inventor: Masataka Deguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/953,489

(22) Filed: Nov. 20, 2020

(65) Prior Publication Data

US 2021/0159676 A1 May 27, 2021

(30) Foreign Application Priority Data

Nov. 21, 2019 (JP) ..... JP2019-210760

(51) Int. Cl.
*H01T 13/39* (2006.01)
*H01T 21/02* (2006.01)
*H01T 13/32* (2006.01)

(52) U.S. Cl.
CPC ..... *H01T 13/39* (2013.01); *H01T 13/32* (2013.01); *H01T 21/02* (2013.01)

(58) Field of Classification Search
CPC ..... H01T 13/39; H01T 21/02; H01T 13/32; H01T 13/20
See application file for complete search history.

(56) References Cited

U.S. PATENT DOCUMENTS 6,078,129 A * 6/2000 Gotou ..... H01T 13/39 313/141
6,528,929 B1 * 3/2003 Matsutani ..... H01T 13/39 313/141
6,533,628 B1 * 3/2003 Matsutani ..... H01T 21/02 219/121.64
2002/0050775 A1 * 5/2002 Hori ..... H01T 13/39 313/141
2003/0038576 A1 * 2/2003 Matsutani ..... H01T 13/39 313/141
2003/0038577 A1 * 2/2003 Hori ..... H01T 21/02 313/141
2003/0155849 A1 * 8/2003 Hori ..... C22C 32/0021 313/141
2004/0189169 A1 * 9/2004 Taniguchi ..... H01T 21/02 313/141

(Continued)

*Primary Examiner* — Kevin Quarterman
(74) *Attorney, Agent, or Firm* — Nixon & Vanderhye P.C.

(57) ABSTRACT

A spark plug has a central electrode and a ground electrode. The central electrode has an electrode base material part and a noble metal chip of a cylindrical shape and is welded on the electrode base material part. A spark discharge is generated between the noble metal chip of the central electrode and the ground electrode when supplying a predetermined voltage to the spark plug. An intermediate region is formed on an overall surface between the electrode base material part and the noble metal chip. The intermediate region has a primary measurement part and a secondary measurement part. Components of the noble metal chip in the primary measurement area have a first average ratio of not less than 40 wt %, and components of the noble metal chip in the secondary measurement area have a second average ratio of not more than 80 wt %.

7 Claims, 10 Drawing Sheets

(56) References Cited

U.S. PATENT DOCUMENTS

| | | | | |
|---|---|---|---|---|
| 2005/0057133 | A1* | 3/2005 | Hori | H01T 13/39 313/141 |
| 2007/0216276 | A1* | 9/2007 | Takada | H01T 21/02 313/141 |
| 2010/0253203 | A1 | 10/2010 | Suzuki et al. | |
| 2017/0125981 | A1 | 5/2017 | Suzuki | |
| 2017/0331260 | A1† | 11/2017 | Quest | |
| 2020/0021084 | A1* | 1/2020 | Kimura | H01T 13/32 |

* cited by examiner
† cited by third party

FIG.8

PRIMARY MEASUREMENT AREA AT NOBLE METAL CHIP SIDE

| RATIO wt% OF COMPONENTS OF NOBLE METAL CHIP IN PRIMARY MEASUREMENT AREA | TEMPERATURE | | |
|---|---|---|---|
| | 800℃ | 900℃ | 950℃ |
| 32 | × | × | × |
| 38 | × | × | × |
| 40 | ○ | × | × |
| 44 | ○ | ○ | × |
| 48 | ○ | ○ | ○ |
| 54 | ○ | ○ | ○ |
| 60 | ○ | ○ | ○ |
| 73 | ○ | ○ | ○ |
| 80 | ○ | ○ | ○ |
| 84 | ○ | ○ | ○ |

○ : NO CRACKING OCCURRENCE, × : CRACKING OCCURRENCE

FIG.9

SECONDARY MEASUREMENT AREA AT ELECTRODE BASE MATERIAL PART SIDE

| RATIO wt% OF COMPONENTS OF NOBLE METAL CHIP IN SECONDARY MEASUREMENT AREA | TEMPERATURE | | |
|---|---|---|---|
| | 800℃ | 900℃ | 950℃ |
| 35 | ○ | ○ | ○ |
| 45 | ○ | ○ | ○ |
| 51 | ○ | ○ | ○ |
| 57 | ○ | ○ | ○ |
| 62 | ○ | ○ | ○ |
| 65 | ○ | ○ | ○ |
| 70 | ○ | ○ | ○ |
| 75 | ○ | ○ | × |
| 80 | ○ | × | × |
| 85 | × | × | × |

○ : NO CRACKING OCCURRENCE, × : CRACKING OCCURRENCE

FIG.10
| R1/R2 | | | | | | |
|---|---|---|---|---|---|---|
| 0.9 | 1.0 | 1.1 | 1.2 | 1.3 | 1.4 | 1.5 |
| × (NOBLE METAL CHIP SIDE) | ○ | ○ | ○ | ○ | ○ | × (MIDDLE) |
○ : NO CRACKING OCCURRENCE, × : CRACKING OCCURRENCE
FIG.11
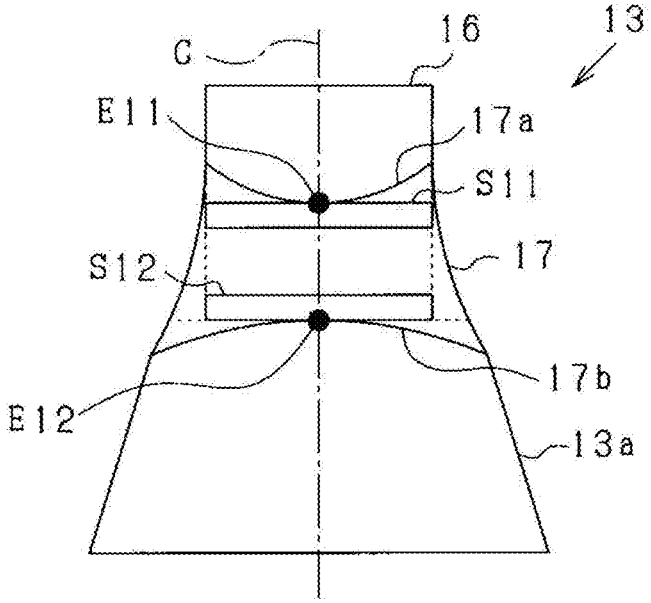
FIG.12
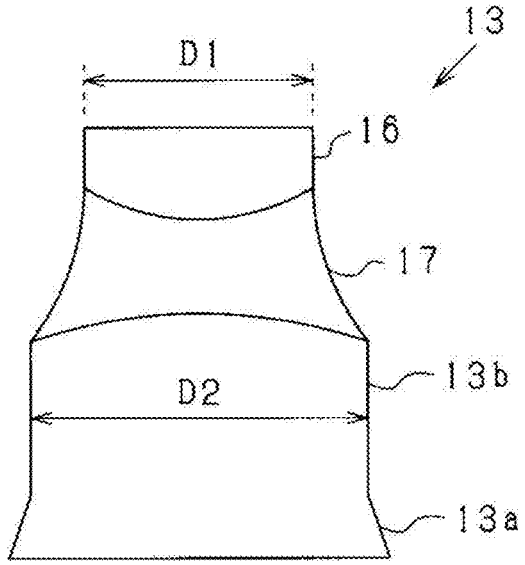

SPARK PLUG AND METHOD OF PRODUCING CENTRAL ELECTRODE THEREOF

CROSS-REFERENCE TO RELATED APPLICATION

This application is related to and claims priority from Japanese Patent Application No. 2019-210760 filed on Nov. 21, 2019, the contents of which are hereby incorporated by reference.

TECHNICAL FIELD

The present disclosure relates to spark plugs.

BACKGROUND

A common spark plug has a central electrode with a fused part formed between a noble metal chip and an electrode base material part. The electrode base material part and the noble metal chip have been fused and solidified to form the fused part. In this spark plug, the fused part of the central electrode has a fused area, formed on the overall side surface of the noble metal chip, of not less than 0.092 mm length. This structure may suppress occurrence of cracking on a boundary between the noble metal chip and the fused part, and provides a reliable joint between the electrode base material part and the noble metal chip.

However; the spark plug previously disclosed requires a strict adjustment in length of the fused area, and prevents a stable and reliable joint between the electrode base material part and the noble metal chip.

SUMMARY

It is desired for the present disclosure to provide a spark plug having a central electrode and a ground electrode. The central electrode has an electrode base material part and a noble metal chip. The noble metal chip has a cylindrical shape and is welded on the electrode base material part. The ground electrode is arranged facing a tip surface in an axial direction of the noble metal chip of the central electrode. A spark discharge is generated between the noble metal chip of the central electrode and the ground electrode. Further, an intermediate region, i.e. a mixture part is formed on the overall surface between the electrode base material part and the noble metal chip in the central electrode. In the intermediate region, components of the electrode base material part and components of the noble metal chip are mixed together. A primary measurement area is formed in the intermediate region to be in contact with a boundary between the noble metal chip and the intermediate region. A secondary measurement area is formed in the intermediate region to be in contact with a boundary between the electrode base material part and the intermediate region. In particular, components of the noble metal chip in the primary measurement area have a first average ratio of not less than 40 wt %. Components of the noble metal chip in the secondary measurement area has a second average ratio of not more than 80 wt %.

BRIEF DESCRIPTION OF THE DRAWINGS

A preferred, non-limiting embodiment of the present disclosure will be described by way of example with reference to the accompanying drawings, in which:

FIG. 8 is a table showing a first average ratio of components in the primary measurement area arranged at the noble metal chip side, and a presence of cracking in test samples;

FIG. 9 is a table showing a second average ratio of components in the secondary measurement area arranged at the electrode base material part side, and a presence of cracking in test samples;

FIG. 10 is a table showing a ratio in components between the primary measurement area at the noble metal chip side and the secondary measurement area at the electrode base material part side, and a presence of cracking in test samples;

FIG. 11 is a schematic view showing measurement points to measure the first and second average ratios of components of the noble metal chip in the primary measurement area and the secondary measurement area in the spark plug according to a first modification of the present disclosure;

FIG. 12 is a view showing an example of an electrode base material part having a different shape in the spark plug according to a second modification of the present disclosure;

DETAILED DESCRIPTION OF THE PREFERRED EMBODIMENTS

Figure 1:
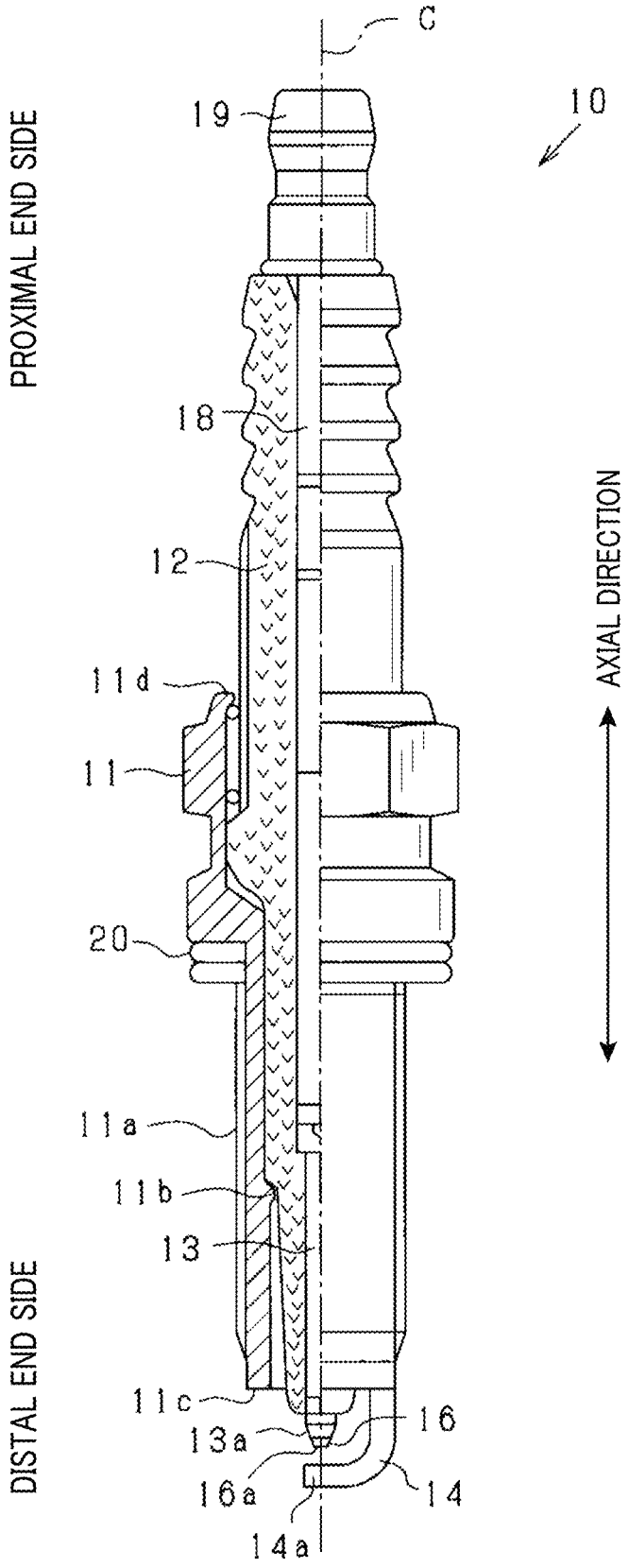
FIG. 1 is a view showing a half cross section of a spark plug according to an exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

Exemplary Embodiment

A description will be given of a spark plug according to an exemplary embodiment of the present disclosure with reference to FIG. 1 to FIG. 10. FIG. 1 is a view showing a half cross section of the spark plug 10 according to the exemplary embodiment of the present disclosure.

As shown in FIG. 1, the spark plug 10 has a housing 11 of a cylindrical shape made of metal member such as of iron. A screw part 11*a* is formed at the bottom side of an outer periphery of the housing 11 as a base metal fitting. For example, the screw part 11*a* has an outer diameter of 10 mm.

An insulator 12 has a cylindrical shape. A bottom part of the insulator 12 has been inserted and fixed to the inside of the housing 11. The insulator 12 is made of an insulator such as of alumina, etc. The top end part 11*d* of the housing 11 is caulked to assemble the insulator 12 and the housing 11 together.

A central electrode 13 has been inserted and supported to the inside of the insulator 12. The central electrode 13 is made of base material such as of nickel (Ni) having superior thermal resistance. The central electrode 13 has a cylindrical shape. Specifically, the central electrode 13 is composed of a base material and an outer material. The base material of the central electrode 13 is made of copper and the outer material thereof is made pf nickel alloy (Ni alloy). A tip part of the central electrode 13 projects from the bottom part as one end of the insulator 12. A noble metal chip 16 is arranged at the tip of the central electrode 13. The noble metal chip 16 has a cylindrical shape.

The central electrode 13, the housing 11 and the insulator 12 are concentrically arranged in the axial direction of the spark plug 10. That is, the central line of each of the central electrode 13, the housing 11 and the insulator 12 coincides with the central axis line C of the spark plug 10.

In general, the central axis part 18 and a terminal part 19 arranged at the proximal end side of the central electrode 13 are electrically connected. The terminal end side of the central electrode 13 is connected to an external circuit which supplies a high voltage as a spark discharge to the spark plug 10. The upper side of the screw part 10*a* of the housing 11 is fitted with a gasket 20 to be fixed to an internal combustion engine (not shown). When the spark plug 10 is attached to a combustion chamber of the internal combustion engine, the central electrode 13 and the ground electrode 14 of the spark plug 10 are exposed to the inside of the combustion chamber of the internal combustion engine. A direction from the central electrode 13 toward the tip part 14*a* of the ground electrode 14 corresponds to the central direction of the combustion chamber of the internal combustion engine.

The ground electrode 14 is formed extending from a tip surface 11*c* as one end surface of the housing 11. An extended part of the ground electrode 14 is arranged in the axial direction of the spark plug 10, and the flat part of the ground electrode 14 is arranged in the radial direction of the spark plug 10. The ground electrode 14 of a curved shape is arranged to face a tip surface 16*a* of the noble metal chip 16 of the central electrode 13. The ground electrode 14 is made of a nickel alloy (Ni alloy).

A spark gap is formed between the tip surface 16*a* of the noble metal chip 16 of the central electrode 13 and the tip part 14*a* of the ground electrode 14. That is, a spark discharge may occur in the spark gap formed between the tip surface 16*a* of the noble metal chip 16 of the central electrode 13 and the tip part 14*a* of the ground electrode 14 when receiving a predetermined voltage supplied from an external power source (not shown).

The outer diameter of the noble metal chip 16 is 0.7 mm in length, for example, and the noble metal chip is 0.6 mm in length in the axial direction of the spark plug 10 before the welding process. The noble metal chip 16 is made of iridium alloy (Ir alloy), for example. For example, Ir alloy has an alloy composition of Iridium (Ir) 90 wt % and Rhodium (Rh) 10 wt %.

Figure 7:
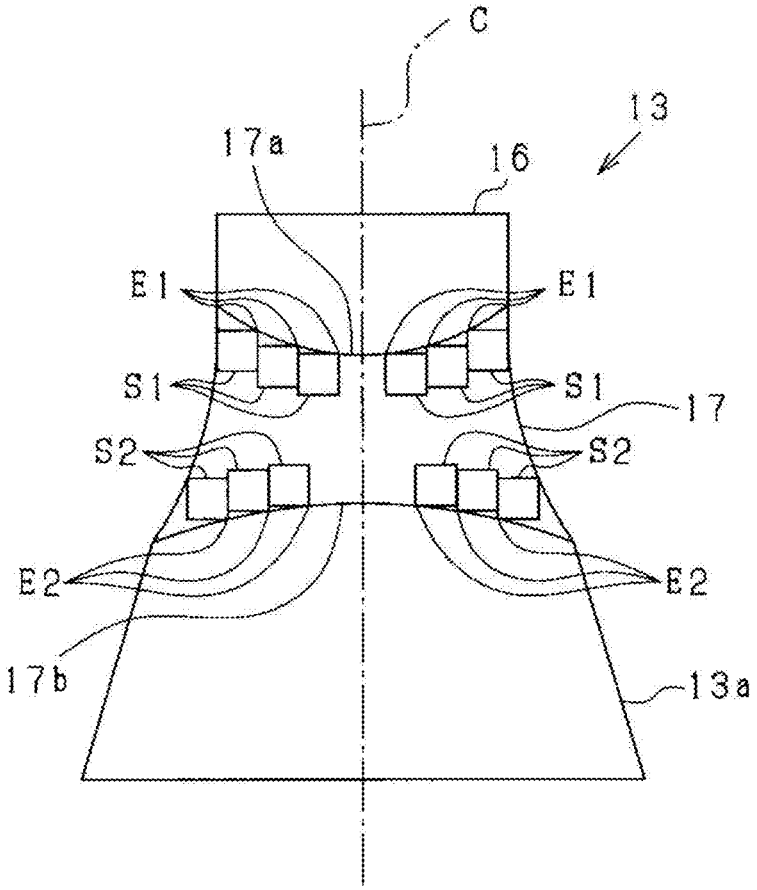
FIG. 7 is a schematic view showing measurement points in a primary measurement area and a secondary measurement area to measure first and second average ratios of component of the noble metal chip in the primary measurement area and the secondary measurement area in the central electrode of the spark plug.

FIG. 7 is a schematic view showing measurement points to measure a first average ratio and a second average ratio of component of the noble metal chip 16 in the primary measurement area and the secondary measurement area in the central electrode 13 of the spark plug 10.

As shown in FIG. 7, an intermediate region 17 (as a mixture part) or a welded part 17 is formed between an electrode base material part 13*a* of the central electrode 13 and the noble metal chip 16. The welded part 17, i.e., the intermediate region has been formed during the formation of the noble metal chip 16 on the tip side surface of the electrode base material part 13*a* by a laser welding process. The components (Ni, etc.) of the electrode base material part 13*a* and the components (Ir and Rh) of the noble metal chip 16 are mixed in the welded part 17. That is, the welded part 17 is formed after the electrode base material part 13*a* and the noble metal chip 16 are fused and solidified.

Figure 2:
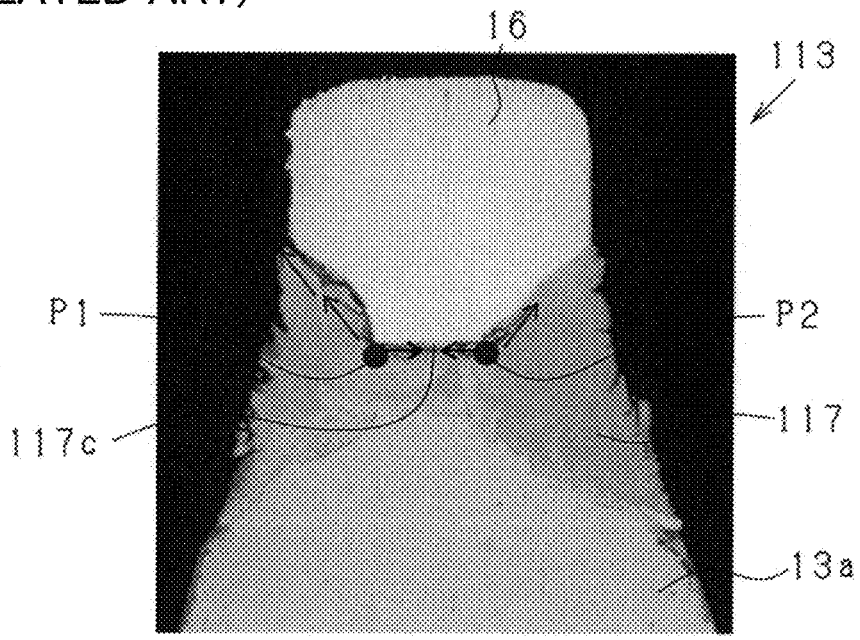
FIG.2 (RELATED ART)
FIG. 2 is a photograph showing a cross section of a central electrode of a spark plug according to related art.

FIG. 2 is a photograph showing a cross section of a central electrode 113 of a spark plug according to related art. As shown in the cross section of the photograph of FIG. 3, an insufficiently fused part 117*c* remains in an area between the electrode base material part 13*a* and the noble metal chip 16 in the central electrode 13. In the insufficiently fused part 117*c*, the electrode base material part 13*a* and the noble metal chip 16 have not been sufficiently fused. That is, the components of the electrode base material part 13*a* and the components of the noble metal chip 16 have not been mixed in the insufficiently fused part 117*c*.

A thermal stress is generated and concentrated at end parts P1 and P2 of the insufficiently fused part 117*c* of the central electrode 113 because of performing a repetition of heating and cooling processes during the use of this spark plug. As clearly shown and indicated by the arrows in FIG. 2, cracking have occurred at the end parts P1 and P2.

Figure 3:
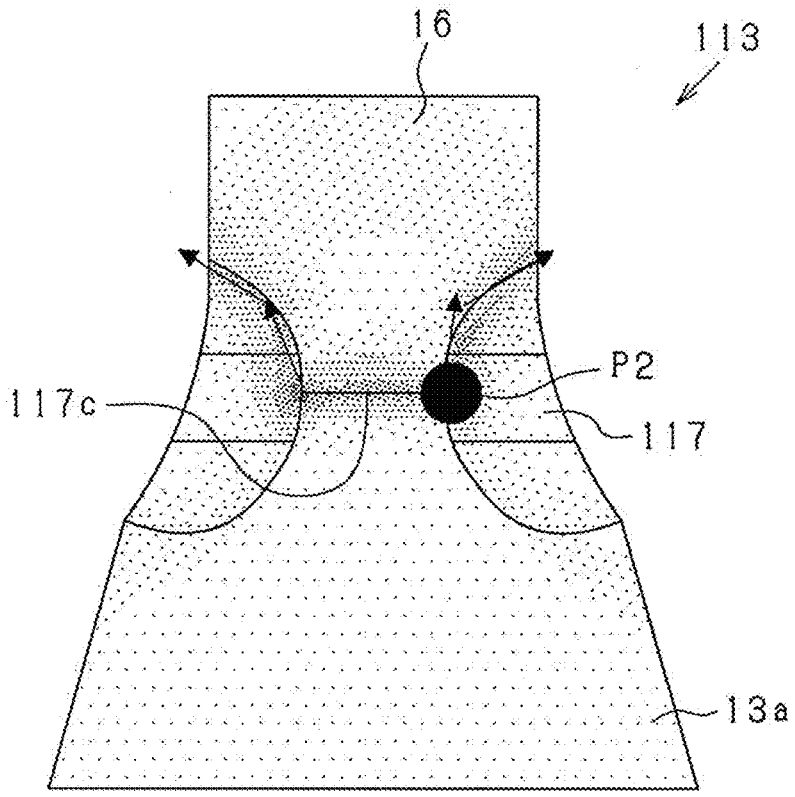
FIG.3 (RELATED ART)
FIG. 3 is a view showing a thermal stress analysis results of the central electrode having an insufficiently fused part which has not been adequately fused in the central electrode of the spark plug according to the related art.

FIG. 3 is a view showing a thermal stress analysis results of the central electrode having an insufficiently fused part which has not been adequately fused in the spark plug according to the related art. As shown in FIG. 3, the higher the density of dots is increased, the more a magnitude of the thermal stress is increased. As shown in FIG. 3, a thermal stress becomes high at a boundary between the noble metal chip 16 and the fused part 117. The maximum thermal stress occurs at the end part P2 of the insufficiently fused part 117*c*.

Figure 4:
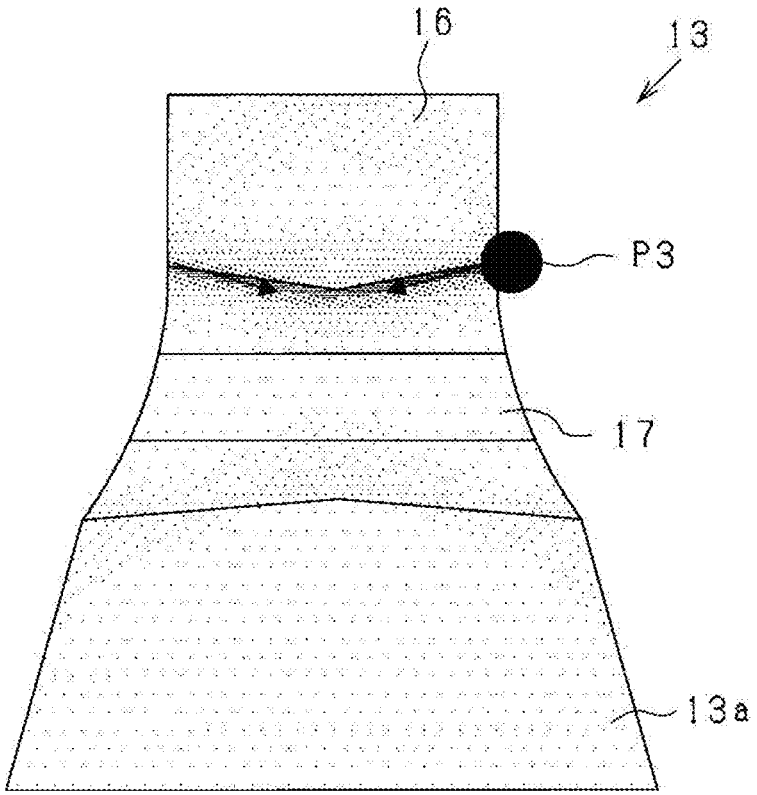
FIG. 4 is a view showing results of a thermal stress analysis of the central electrode without any insufficiently fused part in the spark plug according to the exemplary embodiment of the present disclosure.

FIG. 4 is a view showing results of a thermal stress analysis of the central electrode 13 without any insufficiently fused part in the spark plug 10 according to the exemplary embodiment of the present disclosure. As shown in FIG. 4, the higher the density of dots is increased, the more a magnitude of the thermal stress is increased. A thermal stress becomes high at a boundary between the noble metal chip 16 and the welded part 17 in the central electrode 13. The maximum thermal stress occurs at an outer peripheral part P3 in the boundary between the noble metal chip 16 and the welded part 17 of the central electrode 13.

Figure 5:
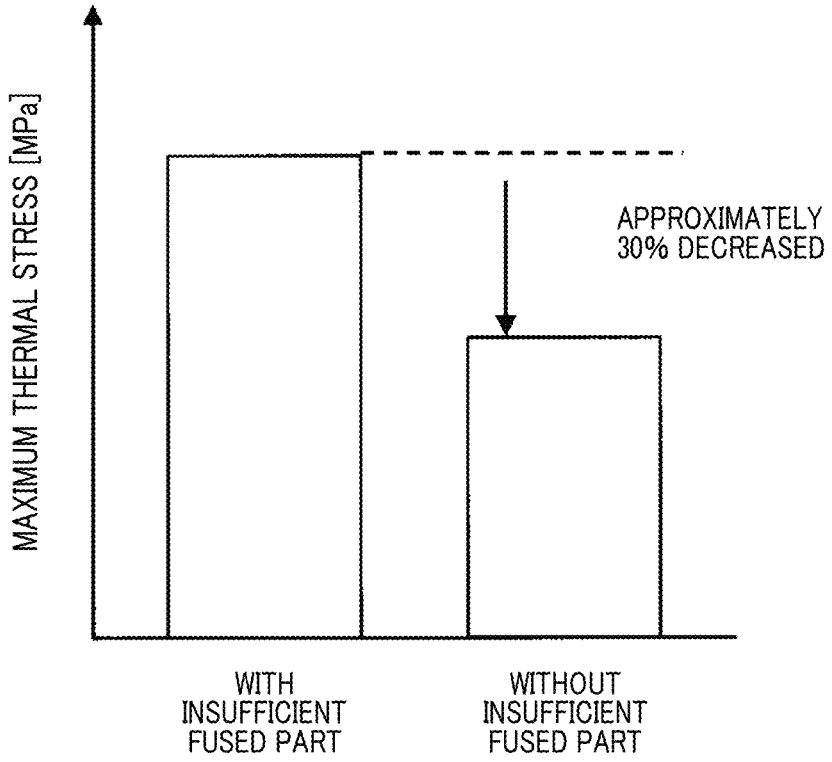
FIG. 5 is a graph showing a relationship between a presence of the insufficiently fused part and a maximum thermal stress in a spark plug.

FIG. 5 is a graph showing a relationship between a presence of the insufficiently fused part 117*c* and a maximum thermal stress in a spark plug. As clearly understood from the relationship shown in FIG. 5, the central electrode 13 without any insufficiently fused part 117*c* has the maximum thermal stress smaller by approximately 30% of a thermal stress generated in the central electrode 113 having the insufficiently fused part 117*c*. In other words, a thermal stress generated in the central electrode having the insufficiently fused part 117*c*, which remains therein, during the use of the spark plug becomes approximately 43% increased, i.e. becomes 143% of a thermal stress of a central electrode without any insufficiently fused part. Accordingly, it is possible to reduce a thermal stress generated during the use of the spark plug having a structure in which there is no insufficiently fused part 117*c* remaining at the boundary between the electrode base material part 13*a* and the noble metal chip 16.

In order to produce this structure of the centrale electrode in the spark plug 10, the exemplary embodiment performs a laser welding process. The use of the laser welding provides an improved structure of the central electrode 13 in the spark plug 10 which allows the welded part 17 as the intermediate region to be formed in the overall surface between the electrode base material part 13*a* and the noble metal chip 16. The components of the electrode base material part 13*a* and the components of the noble metal chip 16 have been mixed together in the welded part 17 as the intermediate region.

Figure 6:
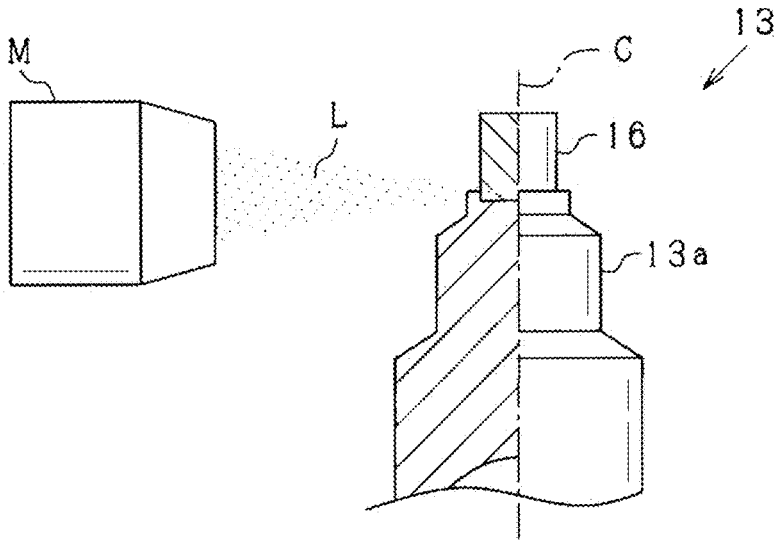
FIG. 6 is a schematic view showing a laser welding method of performing a laser welding process to produce the central electrode of the spark plug according to the exemplary embodiment.

FIG. 6 is a schematic view showing a laser welding method of performing a laser welding process to produce the central electrode 13 of the spark plug 10 according to the exemplary embodiment. In the laser welding process, the tip surface of the electrode base material part 13*a* is in contact with a rear end surface of the noble metal chip 16, The laser welding process uses a laser welding machine (see FIG. 6) to irradiate a laser light L to the inside of the noble metal chip 16 from the outer peripheral side of the noble metal chip 16. It is possible for the exemplary embodiment to use, as the laser welding machine M, various types of laser machines using a yttrium-aluminum-argon laser (YAG laser), a carbon dioxide laser, a semiconductor laser, a fiber laser, etc. It is acceptable to use pulse width (PW) oscillation or a continuous wave laser (CW) for emission of a laser light L.

Specifically, the laser welding process irradiates the laser light L toward the central axis C of the noble metal chip 16 from the outer peripheral side of the noble metal chip 16. It is preferable to uniformly irradiate the laser light L to the overall periphery of the noble metal chip 16. This allows the welded part 17 to be formed on the overall surface between the electrode base material part 13*a* and the noble metal chip 16. The components of the electrode base material part 13*a* and the components of the noble metal chip 16 are mixed in the welded part 17.

The inventor of the present disclosure has recognized the following phenomenon. The formation of the welded part 17 on the overall surface between the electrode base material part 13*a* and the noble metal chip 16 allows cracking to easily form and grow around the boundary between the noble metal chip 16 and the welded part 17, or the welded part 17 and the electrode base material part 13*a*.

This means that a difference of the thermal expansion coefficient between the noble metal chip 16 and the welded part 17 is increased when the composition of the noble metal chip 16 and the welded part 17 change rapidly. The thermal stress, generated during the use of the spark plug 10, increases at the boundary between the noble metal chip 16 and the welded part 17. This phenomenon makes it possible to easily generate cracking in the boundary between the noble metal chip 16 and the welded part 17.

The exemplary embodiment performs a repetition of the heating and cooling process while changing an average ratio R wt % of the components of the noble metal chip 16 in the primary measurement area at the boundary between the noble metal chip 16 and the welded part 17, and in the secondary measurement area at the boundary between the welded part 17 and the electrode base material part 13*a*, FIG. 7 shows a cross section along the central axis line C of the central electrode 13 in the spark plug, and shows the measurement points to obtain the average ratios R1 and R2 of the components of the noble metal chip 16 in the primary measurement area and the secondary measurement area.

As shown in FIG. 7, the primary measurement area is determined on a cross section, parallel to the central axis line C of the central electrode 13. The primary measurement area is composed of six primary measurement square areas S1 on a cross section of the central electrode 13. Each of the primary measurement square areas S1 has four sides, and each side of each primary measurement square area S1 has a 100 μm in length.

This boundary 17*a* is located between the noble metal chip 16 and the welded part 17. Each of the six primary measurement square areas S1 is arranged for the edge E1 at the noble metal chip 16 side of the primary measurement square area S1 to be in contact with the boundary 17*a* under a situation in which two sides of each primary measurement square area S1 is arranged parallel with the central axis line C. In particular, the six primary measurement square areas S1 are arranged not to be overlapped from each other. That is, the primary measurement area is arranged in the welded part 17 as the intermediate region to be in contact with the boundary 17*a* between the noble metal chip 16 and the welded part 17.

The exemplary embodiment measured ratios of components of the noble metal chip 16 in the six primary measurement square areas S1, and calculate the first average ratio R1 wt % of the components (Ir and Rh) of the noble metal chip 16. The exemplary embodiment calculates, as the first average ratio R1 wt %, an average value of the ratios measured in the six primary measurement square areas S1. For example, it is possible to use an X-ray fluorescence analyzer which irradiates an X ray beam to each of the primary measurement square areas S1 of the welded part 17. It is possible to detect energy that is inherent to each element, generated from the X ray fluorescence. The exemplary embodiment performed a qualitative quantitative analysis to detect each element of the components of the noble metal chip 16.

Similarly, as shown in FIG. 7, the secondary measurement area is determined on a cross section passing through the central axis line C of the central electrode 13. The secondary measurement area is composed of six secondary measurement square areas S2 on a cross section of the central electrode 13. Each of the secondary measurement square areas S2 has four sides, each side of each secondary measurement square area S2 has a 100 μm in length.

Each of the secondary measurement square areas S2 is arranged so that the edge E2 at the electrode base material part 13*a* side of the secondary measurement square area S2 is in contact with the boundary 17*b* between the welded part 17 and the electrode base material part 13*a* under a situation in which two sides of each secondary measurement square area S2 are arranged parallel with the central axis line C. In particular, the six secondary measurement square areas S2 are arranged not to be overlapped from each other. That is, the secondary measurement area is arranged to be in contact with the boundary 17*b* between the welded part 17 and the electrode base material part 13*a*. The six secondary measurement square areas S2 are arranged separated from each other. The secondary measurement area is arranged in the welded part 17 as the intermediate region to be in contact with the boundary 17*b* between the welded part 17 and the electrode base material part 13*a*.

The exemplary embodiment measured a ratio of the component (Ir and Rh) in each of the secondary measurement square areas S2, and calculate the second average ratio R2 wt % of the components of the noble metal chip 16 in the secondary measurement area. The exemplary embodiment calculates, as the average ratio R2 wt %, an average value of the average ratios measured in the six secondary measurement square areas S2.

FIG. 8 is a table showing the calculated first average ratio R1 of the components (Ir and Rh) in the primary measurement area arranged at the noble metal chip 16 side, and a presence of cracking in test samples.

The exemplary embodiment performed the thermal and cooling process 200 times in which the temperature of the central electrode 13 changed from first to third upper temperatures (800° C., 900° C., 950° C.) to the lower temperature (room temperature). The experiment according to the exemplary embodiment detected that cracking have occurred in the test sample when a length of cracking on a cross section passing the central axis line C of the central electrode 13 reached not less than half of the outer diameter of the central electrode 13.

The first upper temperature of 800° C. corresponds to a naturally aspirated engine at a maximum load. The third upper temperature of 950° C. corresponds to a supercharged engine at a maximum load.

At the first upper temperature of 800° C., the experiment according to the exemplary embodiment detected that cracking have occurred in the test samples in which the components had the first average ratio R1 of less than 40 wt %. On the other hand, at the first upper temperature of 800° C., the experiment according to the exemplary embodiment detected that no crack has occurred in the test samples in which the components had the first average ratio R1 of not less than 40 wt %, corresponding to the exemplary embodiment.

At the second upper temperature of 900° C., the experiment according to the exemplary embodiment detected that cracking have occurred in the test samples in which the components had the first average ratio R1 of less than 44 wt %. On the other hand, at the second upper temperature of 900° C., the experiment according to the exemplary embodiment detected that no cracking has occurred in the test samples in which the components had the first average ratio R1 of not less than 44 wt %.

At the third upper temperature of 950° C., the experiment according to the exemplary embodiment detected that cracking have occurred in the test samples in which the components had the first average ratio R1 of less than 48 wt %. On the other hand, at the third upper temperature of 950° C., the experiment according to the exemplary embodiment detected that no cracking has occurred in the test samples in which the components had the first average ratio R1 of not less than 48 wt %.

On the basis of the table shown in FIG. 8, which shows the experimental results, the experiment according to the exemplary embodiment has adjusted the output magnitude of the laser light L of the laser welding machine M, the laser light irradiation position, the irradiation angle, the irradiation times, the irradiation period, the irradiation area (i.e. a laser light spot diameter), etc. in order to determine a preferable first average ratio R1 of the components of the noble metal chip 16 in the primary measurement area in the welded part 17, On the basis of the experimental results, it is preferable for the components of the noble metal chip 16 in the primary measurement area to have the first average ratio R1 of not less than 40 wt %. As previously described, the primary measurement area is arranged to be in contact with the boundary 17*a* between the noble metal part 16 and the welded part 17 (as the intermediate region), It is more preferable for the components of the noble metal chip 16 in the primary measurement area to have the first average ratio R1 of not less than 48 wt %.

FIG. 9 is a table showing the second average ratio r2 of components in the secondary measurement area at the electrode base material part 13*a* side and a presence of cracking in test samples.

Similar to the experiment previously described, the exemplary embodiment performed the thermal and cooling process. The experiment according to the exemplary embodiment detected the second average ratio R2 of the components (Ir and Rh) in the secondary measurement area arranged at the electrode base material part 13*a* side, and the presence of cracking.

At the first upper temperature of 800° C., the experiment according to the exemplary embodiment detected that cracking have occurred in the test samples in which the components in the secondary measurement area had the second average ratio R2 of more than 80 wt %, On the other hand, at the first upper temperature of 800° C., the experiment according to the exemplary embodiment that no cracking has occurred in the test samples in which the components in the secondary measurement area had the second average ratio R2 of less than 80 wt %.

At the second upper temperature of 900° C., the experiment according to the exemplary embodiment detected that cracking have occurred in the test samples in which the components in the secondary measurement area had the second average ratio R2 of more than 75 wt %. On the other hand, at the second upper temperature of 900° C., the experiment according to the exemplary embodiment detected that no cracking has occurred in the test samples in which the components in the secondary measurement area had the second average ratio R2 of not more than 75 wt %.

At the third upper temperature of 950° C., the experiment according to the exemplary embodiment detected that cracking have occurred in the test samples in which the components in the secondary measurement area had the second average ratio R2 of more than 70 wt % On the other hand, at the third upper temperature of 950° C., the experiment according to the exemplary embodiment detected that no cracking has occurred in the test samples in which the components in the secondary measurement area had the second average ratio R2 of not more than 70 wt %.

On the basis of the table showing the experimental results shown in FIG. 9, the exemplary embodiment has adjusted the output magnitude of the laser light L of the laser welding machine M, the laser light irradiation position, the irradiation angle, the irradiation times, the irradiation period, the irradiation area (i.e. the laser light spot diameter), etc., in order to determine a preferable average ratio of the components of the noble metal chip 16 in the secondary measurement area. On the basis of the experimental results, it is preferable for the components of the noble metal chip 16 in the secondary measurement area in the welded part 17 to have the second average ratio R2 of not more than 80 wt %.

As previously described, the secondary measurement area is arrange to be in contact with the boundary 17*b* between the welded part 17 (as the intermediate region) and the electrode base material part 13*a*, It is more preferable for the components of the noble metal chip 16 in the secondary measurement area to have the second average ratio R2 of not more than 70 wt %.

FIG. 10 is a table showing a ratio in components between the primary measurement area at the noble metal chip 16 side and the secondary measurement area at the electrode base material part 13*a* side, and a presence of cracking in test samples.

In FIG. 10, R1 indicates the first average ratio of the components of the noble metal chip 16 in the primary measurement area, which is the total sum of the primary measurement square areas S1, arranged at the noble metal chip 16 side, and R2 indicates the second average ratio of the components of the noble metal chip 16 in the secondary measurement area, which is the total sum of the secondary measurement square areas S2, arranged at the electrode base material part 13*a* side.

Because the primary measurement area is arranged close to the noble metal chip 16 side when compared with the location of the secondary measurement area, the ratio R1/R2 normally satisfies a relationship of 1≤R1/R2.

On the other hand, when the ratio R1/R2 has a relationship of 1>R1/R2, the components in the welded part 17 are nonuniformly mixed. Accordingly, when R1/R2=0.9, it may be considered that the composition in the area between the noble metal chip 16 and the primary measurement area changed rapidly, and cracking have occurred in this area.

When R1/R2=1.5, i.e. R1/R2>1.4, it may be considered that the composition in the area (at the middle area of the welded part 17) between the primary measurement area and the secondary measurement area in the welded part 17 changed rapidly, and cracking have occurred in this area.

The exemplary embodiment of the present disclosure adjusts an output magnitude of the laser light L of the laser welding machine M, the laser light irradiation position, the irradiation angle, the irradiation times, the irradiation period, the irradiation area (i.e. a laser light spot diameter), etc., to satisfy the relationship of 1≤R1/R2≤1.4.

A description will now be given of the following advantage and effects of the spark plug and the method of producing the central electrode of the spark plug according to the exemplary embodiment of the present disclosure.

As previously described, the spark plug 10 according to the exemplary embodiment has the improved structure in which the welded part 17 (or the intermediate region) is formed between the electrode base material part 13*a* and the noble metal chip 16 in the central electrode 13. When a spark plug has a central electrode with the insufficiently fused part 117*c* in which no welded part 17 is formed, a thermal stress generated in the central electrode during the use of the spark plug, becomes increased approximately by 43%, i.e. becomes 143% of a thermal stress generated in the central electrode with the welded part 17 according to the exemplary embodiment of the present disclosure. As a result, this structure of the central electrode having the insufficiently fused part 117*c* allows cracking to easily occur and grow in the insufficiently fused part 117*c* formed between the electrode base material part 13*a* and the noble metal chip 16.

On the other hand, the central electrode 13 of the spark plug 10 according to the exemplary embodiment has the improved structure in which the welded part 17 is formed on the overall area between the electrode base material part 13*a* and the noble metal chip 16. This improved structure makes it possible to suppress cracking from occurring in the central electrode 13.

The welded part 17 as the intermediate region is formed in the central electrode 13 of the spark plug 10 according to the exemplary embodiment. When the components of the noble metal chip 16 in the primary measurement area of the welded part 17, formed to be in contact with the boundary 17*a* at the noble metal chip 16 side, has the first average ratio R1 of not less than 40 wt %, this improved structure of the welded part 17 as the intermediate region prevents cracking from occurring and growing. Further, this improved structure makes it possible to suppress the composition of components between the noble metal chip 16 and the primary measurement area from changing rapidly, and to suppress a difference in thermal expansion coefficient between the noble metal chip 16 and the primary measurement area from being increased. Accordingly, this improved structure makes it possible to reduce the magnitude of a thermal stress generated at the boundary 17*a* between the noble metal chip 16 and the welded part 17 during the use of the spark plug 10.

The formation of the welded part 17 of the central electrode 13 of the spark plug 10 according to the exemplary embodiment prevents cracking from occurring and growing when the components of the noble metal chip 16 in the secondary measurement area, formed in contact with the boundary 17*a* at the electrode base material part 13*a* side, has the second average ratio R2 of not more than 80 wt %. This improved structure makes it possible to suppress the composition of components between the secondary measurement area and the electrode base material part 13*a* from changing rapidly, and to suppress cracking from being occurred in the welded part 17.

In the central electrode 13 of the spark plug 10 according to the exemplary embodiment, the welded part 17 as the intermediate region is formed on the overall surface of the area between the electrode base material part 13*a* and the noble metal chip 16, and it is sufficient for the components of the noble metal chip 16 in each of the primary measurement area and the secondary measurement area to have the first and second average ratios R1 and R2, respectively. This structure does not require any strict adjustment of the dimensions and the composition ratio of the welded part 17, This structure makes it possible to easily produce the central electrode 13 of the spark plug 10 with a reliable and stable joint between the electrode base material part 13*a* and the noble metal chip 16.

In the welded part 17 of the central electrode 13 in the spark plug 10 according to the exemplary embodiment, the components of the noble metal chip 16 in the primary measurement area have the first average ratio R1 of not less than 48 wt %, and the components of the noble metal chip 16 in the secondary measurement area has the second average ratio R2 of not more than 70 wt %. This improved structure makes it possible to suppress the composition of components between the noble metal chip 16 and the primary measurement area from changing rapidly, and to suppress the composition of components between the secondary measurement area and the electrode base material part 13*a* from changing rapidly. This improved structure makes it further possible to reduce a thermal stress from being generated in the central electrode during the use of the spark plug 10. This structure makes it possible to easily produce the central electrode 13 of the spark plug 10 with a reliable and stable joint between the electrode base material part 13*a* and the noble metal chip 16.

When 1>R1/R2, there is a possible case in which the components in the welded part 17 are nonuniformly mixed. In this case, it can be considered that the composition of components between the noble metal chip 16 and the primary measurement area or between the secondary measurement area and the electrode base material part 13*a* have changed rapidly. In this case, cracking may easily grow.

When R1/R2>1.4, it can be considered that the composition of components between the primary measurement area and the secondary measurement area in the welded part 17 change abruptly. In this case, cracking may easily occur and grow.

Because the central electrode 13 of the spark plug 10 according to the exemplary embodiment satisfies the relationship of 1≤R1/R2≤1.4. This improved structure makes it possible to suppress cracking from growing.

In the improved structure of the central electrode 13 in the spark plug 10 according to the exemplary embodiment, the primary measurement area is determined to be composed of the primary measurement square areas S1 on a cross section passing through the central axis line C of the central electrode 13. Each primary measurement square area S1 has the side of 100 μm. The edge E1, at the noble metal chip 16 side, of the primary measurement square area S1 is in contact with the boundary 17*a* between the noble metal chip 16 and the welded part 17 when the two sides of the primary measurement square area S1 are arranged parallel with the central axis line C of the central electrode 13. This arrangement makes it possible to stably form the primary measurement area close to the boundary 17*a* between the noble metal chip 16 and the welded part 17. This makes it possible to improve the measurement accuracy to calculate the first average ratio R1 of the components of the noble metal chip 16 around the boundary 17*a* between the noble metal chip 16 and the welded part 17, Similarly, this makes it possible to improve the measurement accuracy to calculate the second average ratio R2 of the components of the noble metal chip 16 around the boundary 17*b* between the welded part 17 and the electrode base material part 13*a*. This makes it possible to provide the stable joint between the electrode base material part 13*a* and the noble metal chip 16 with high reliability.

In the method of producing the central electrode 13 of the spark plug 10 according to the exemplary embodiment, the welded part 17 is formed on the overall surface between the electrode base material part 13*a* and the noble metal chip 16, where the components of the electrode base material part 13*a* and the components of the noble metal chip 16 are mixed in the welded part 17 formed between the electrode base material part 13*a* and the noble metal chip 16. This makes it possible to easily melt the electrode base material part 13*a* and the noble metal chip 16 in depth, and to easily form the welded part 17 on the overall surface between the electrode base material part 13*a* and the noble metal chip 16. Further, this makes it possible to adjust a fused amount of the components of the electrode base material part 13*a* and the noble metal chip 16 with high accuracy. Accordingly, it is possible for the components of the noble metal chip 16 in the primary measurement area to easily have the first average ratio R1 of not less than 40 wt %, and for the components of the noble metal chip 16 in the secondary measurement area to easily have the second average ratio R2 of not more than 80 wt %.

The concept of the present disclosure is not limited by the structure, behavior and effects of the spark plug 10 according to the exemplary embodiment previously described. It is possible for the present disclosure to have the following modifications. In the following modifications, the same components between the exemplary embodiment and the following modifications will be referred to with the same reference numbers and characters. The explanation of the same components will be omitted for brevity.

In the structure of the central electrode 13 in the spark plug 10 according to the exemplary embodiment previously described, it is possible for each of the primary measurement square areas S1 and the secondary measurement square areas S2 to have a side which is shorter or longer than 100 μm. It is also possible for the primary measurement area to have the primary measurement square areas S1 of less or more than six. Similarly, it is also possible for the secondary measurement area to have the secondary measurement square areas S2 of less or more than six.

(First Modification)

A description will be given of the central electrode 13 of the spark plug 10 according to a first modification of the present disclosure with reference to FIG. 11.

FIG. 11 is a schematic view showing measurement points to measure the first average ratio R1 and the second average ratio R2 of components of the noble metal chip in the primary measurement area and the secondary measurement area in the spark plug according to the first modification. FIG. 11 is a cross section passing through the central electrode line C of the central electrode 13.

In the first modification of the present disclosure shown in FIG. 11, the primary measurement area corresponds to a primary measurement rectangle area S11 having a short side of 100 μm in length, and a long side of 0.7 mm which is equal to the outer diameter of the noble metal chip 16.

In a radial direction of the noble metal chip 16, the position of the two short sides of the primary measurement rectangle area S11 corresponds to the position of both end sides of the noble metal chip 16.

When the two short sides of the primary measurement rectangle area S11 are arranged to be parallel with the central axis line C of the central electrode 13, the primary measurement rectangle area S11 is arranged so that the edge E11, at the noble metal chip 16 side, of the primary measurement rectangle area S11 is in contact with the boundary 17*a* between the noble metal chip 16 and the welded part 17.

That is, as shown in FIG. 11, the primary measurement area is arranged to be in contact with the boundary 17*a* between the welded part 17 and the noble metal chip 16. The first modification uses, as the first average ratio R1 wt % of the components of the noble metal chip 16 in the primary measurement area, the average ratio of the components (such as of Ir and Rh) of the noble metal chip 16 in the primary measurement rectangle area S11.

Similarly, in the first modification of the present disclosure shown in FIG. 11, the secondary measurement area corresponds to a secondary measurement rectangle area S12 having a short side of 100 μm in length, and a long side of 0.7 mm which is equal to the outer diameter of the noble metal chip 16.

In the radial direction of the noble metal chip 16, the position of the two short sides of the secondary measurement rectangle area S12 corresponds to the position of both ends of the noble metal chip 16.

When the two short sides of the secondary measurement rectangle area S12 are arranged to be parallel with the central axis line C of the central electrode 13, the secondary measurement rectangle area S12 is arranged so that the edge E12, at the electrode base material part 13*a* side, of the secondary measurement rectangle area S12 is in contact with the boundary 17*b* between the welded part 17 and the electrode base material part 13*a*, That is, as shown in FIG.

11, the secondary measurement area is arranged to be in contact with the boundary 17*a* between the welded part 17 and the electrode base material part 13*a*. The first modification uses, as the second average ratio R2 wt % of the components, i.e. Ir and Rh of the noble metal chip 16 in the secondary measurement area, the average ratio of the components of the noble metal chip 16 in the secondary measurement rectangle area S12.

It is acceptable for the primary measurement rectangle area S11 to have the short sides of less than or more than 100 μm in length. It is also acceptable for the secondary measurement rectangle area S12 to have the short sides of less than or more than 100 μm in length.

(Second Modification)

A description will be given of the central electrode of the spark plug according to a second modification of the present disclosure with reference to FIG. 12.

FIG. 12 is a view showing an example of the electrode base material part 13*a* having a different shape in the spark plug according to a second modification of the present disclosure.

As shown in FIG. 12, the electrode base material part 13*a* has a cylindrical shape. An equal-diameter part 13*b* is formed to be in contact with the welded part 17 as the intermediate region. This structure makes it possible to maintain the outer diameter of the electrode base material part 13*a* at the welded part even if the position of the welded part varies along the axial direction of the noble metal chip 16. This structure makes it possible to suppress the composition of the welded part 17 from changing. Further, the spark plug according to the second modification satisfies a relationship of $0.6 \leq D1/D2 \leq 0.9$, where D1 represents the outer diameter of the noble metal chip 16, and D2 indicates the outer diameter of the equal-diameter part 13*b*. This structure makes it possible to suppress the position of the electrode base material part 13*a* and the position of the noble metal chip 16 from being varied in the radial direction of the central electrode 13. Accordingly, this makes it possible to provide the central electrode of the spark plug having the stable first and second average ratios R1 and R2 of the components of the noble metal chip 16 in the primary measurement area and the secondary measurement area.

(Third Modification)

A description will be given of the central electrode of the spark plug according to a third modification of the present disclosure with reference to FIG. 13.

Figure 13:
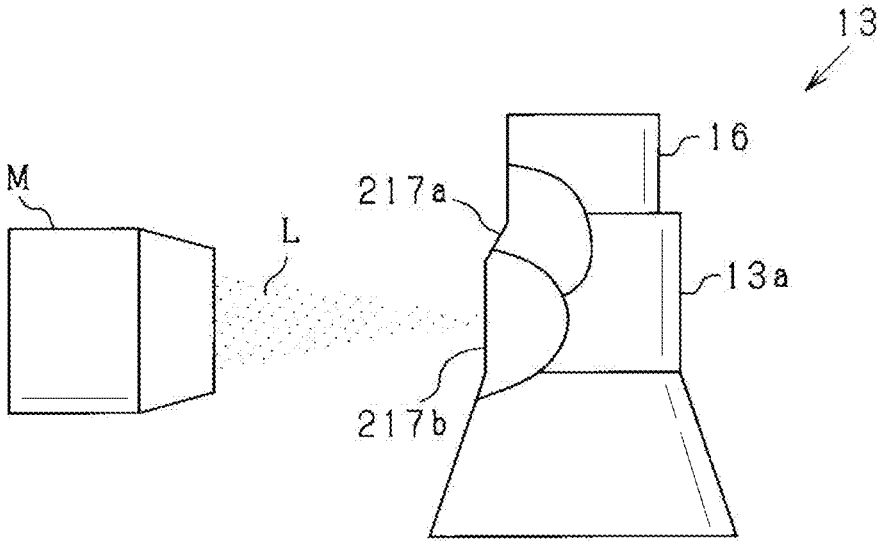
FIG. 13 is a schematic view showing another laser welding method of producing a central electrode of the spark plug according to a third modification of the present disclosure.

FIG. 13 is a schematic view showing another laser welding method of producing a central electrode of the spark plug according to the third modification of the present disclosure. In the laser welding method according to the third modification, a second welded part 217*b* is formed at a location apart from the noble metal chip 16 side from the first welded part 217*a* by using the laser welding. This process forms the welded part 17 as the intermediate region by performing the laser welding. That is, the second welded part 217*b* is formed to be overlapped with a part of the first welded part 217*a* in the axial line of the noble metal chip 16 after the first welded part 217*a* is formed by the laser welding process. This structure of the central electrode 13 makes it possible to easily reduce the second average ratio R2 of the components of the noble metal chip 16 in the second welded part 217*b* less than the first average ratio R1 of the components of the noble metal chip 16 in the first welded part 217*a*. That is, this structure of the central electrode 13 makes it possible to easily adjust the second average ratio R2 of the components of the noble metal chip 16 in the second welded part 217*b*.

(Fourth Modification)

Figure 14:
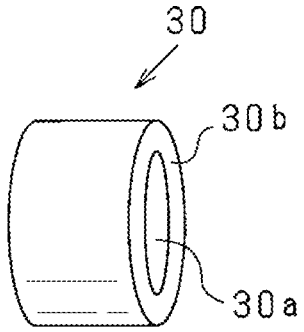
FIG. 14 a schematic view showing a lens of the laser welding machine M to be used for performing the laser welding method according to a fourth modification of the present disclosure.
Figure 15:
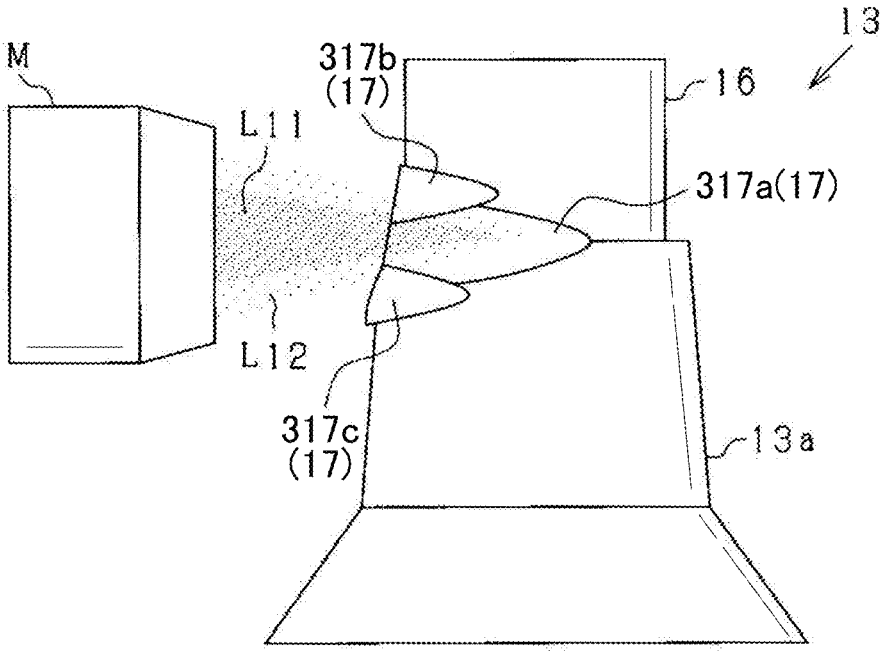
FIG. 15 is a schematic view showing the laser welding machine using the lens shown in FIG. 14 to produce an intermediate region (i.e. a welded part) in the central electrode of the spark plug according to the fourth modification of the present disclosure.

A description will be given of a lens of the laser welding machine M to be used for producing the central electrode of the spark plug a according to a fourth modification of the present disclosure with reference to FIG. 14 and FIG. 15, FIG. 14 a schematic view showing a lens of the laser welding machine M to be used for performing the laser welding method according to the fourth modification of the present disclosure. FIG. 15 is a schematic view showing the laser welding machine using the lens shown in FIG. 14 to produce the welded part 17 in the central electrode of the spark plug according to the fourth modification. The lens 30 of the laser welding machine M shown in FIG. 14 and FIG. 15 is composed of a central part 30*a* and a peripheral part 30*b*. The central part 30*a* has a transmittance which is higher than that of the peripheral part 30*b*. As shown in FIG. 15, the welded part 17 is composed of a first welded part 317*a* (as a first intermediate region), a second welded part 317*b* (as a second intermediate region) and a third welded part 317*c* (as a third intermediate region). That is, the first welded part 317*a* is formed by the laser light L11 passing through the central part 30*a* of the lens. The second welded part 317*b* and the third welded part 317*c* are formed by the laser light L12 passing through the peripheral part 30*b* of the lens. This process makes it possible to easily form the first welded part 317*a* on the overall surface of the area between the electrode base material part 13*a* and the noble metal chip 16 in the central electrode 13. Further; this process makes it possible to easily and precisely adjust the first average ratio R1 of the components of the noble metal chip 16 in the primary measurement area at the noble metal chip 16 side, and to easily and precisely adjust the second average ratio R2 of the components of the noble metal chip 16 in the secondary measurement area at the electrode base material part 13*a* side, (Other Modifications)

In the structure of the central electrode 13 of the spark plug 10 according to the present disclosure, it is possible for an Ir alloy forming the noble metal chip 16 to have a Ir composition of 73 wt % and a Rh composition of 27 wt %. The spark plug having the central electrode 13 with the noble metal chip 16 having such a composition of Ir and Rh has the same effects of the spark plug 10 according to the exemplary embodiment previously described.

It is acceptable to add another metal component into the Ir alloy instead of using Rh. Further it is possible to form the noble metal chip 16 by using a Pt alloy. This structure makes it possible to have the same effects of the exemplary embodiment.

It is possible for the spark plug 10 to have another structure in which the noble metal chip is formed at the distal end part 14*a* of the ground electrode 14. It is preferable to use a Ir—Rh alloy in the noble metal chip to reduce Ir high-temperature volatility. As well known, Iridium (Ir) has a high melting point and superior consuming properties.

Further, it is acceptable to use a Pt alloy to form the noble metal chip, and it is also acceptable for the screw part 11*a* to have the outer diameter of less than or more than 10 mm.

As previously described in detail, the spark plug 10 according to the exemplary embodiment of the present disclosure has the following features, behavior and effects.

In the improved structure previously described, the spark plug according to an exemplary embodiment of the present disclosure has the central electrode and the ground electrode. The central electrode has the electrode base material part and the noble metal chip. The noble metal chip has a cylindrical shape and is joined by welding onto the electrode base material part. The ground electrode is arranged facing a tip surface in an axial direction of the noble metal chip. A spark discharge occurs between the noble metal chip of the central electrode and the ground electrode when a predetermined voltage is supplied to the spark plug.

The inventor of the present disclosure has r that when a central electrode with an insufficiently fused part has a maximum thermal stress during the use of the spark plug. The insufficiently fused part remains in the central electrode. Such a maximum thermal stress of the central electrode with the insufficiently fused part becomes approximately 143% of a thermal stress of a central electrode without such an insufficiently fused part. That is, the thermal stress of the central electrode with the insufficiently fused part becomes approximately 43% increased as compared with that of a central electrode without the insufficiently fused part. This allows cracking from easily occurring and growing in the area without any intermediate region, to be formed between the electrode base material part and the noble metal chip. On the other hand, because the spark plug according to the present disclosure has the intermediate region formed on the overall surface of the boundary between the electrode base material part and the noble metal chip, this structure makes it possible to suppress cracking from occurring in the central electrode.

In particular; the inventor of the present disclosure has detected that the formation of the intermediate region on the overall surface between the electrode base material part and the noble metal chip allows cracking to easily form and grow around the boundary between the noble metal chip and the intermediate region or the intermediate region and the electrode base material part.

In order to avoid such drawbacks, the inventor of the present disclosure has realized that it is possible to prevent and suppress cracking from occurring when the components of the noble metal chip in the primary measurement area, to be in contact with the boundary to the noble metal chip, has the first average ratio R1 of not less than 40 wt %. This improved structure of the spark plug makes it possible to suppress the composition of the components in the noble metal chip and the primary measurement area from changing rapidly, and to suppress a difference in thermal expansion coefficient between the noble metal chip and the primary measurement area from being increased. Accordingly, it is possible to reduce a thermal stress generated at the noble metal chip and the intermediate region during the use of the spark plug, and to suppress cracking from occurring in the intermediate region in the central electrode.

Further, the inventor of the present disclosure has recognized that it is possible to prevent and suppress cracking from occurring when the components of the noble metal chip in the secondary measurement area, to be in contact with the boundary to the electrode base material part, has the second average ratio R2 of not more than 80 wt %. This improved structure makes it possible to suppress the composition of the components in the electrode base material part and the secondary measurement area from changing rapidly, and possible to suppress a difference in thermal expansion coefficient between the electrode base material part and the secondary measurement area from being increased. Accordingly, it is possible to reduce a thermal stress generated at the electrode base material part and the intermediate region during the use of the spark plug, and to suppress cracking from occurring in the intermediate region in the central electrode.

It is possible to adjust the first average ratio and the second average ratio in the primary measurement area and the secondary measurement area after the intermediate region, i.e. the welded part, is formed on the overall surface between the electrode base material part and the noble metal chip. This structure does not require any strict adjustment dimensions and composition ratio of the intermediate region. This structure makes it possible to easily produce the central electrode of the spark plug with a reliable and stable joint between the electrode base material part and the noble metal chip.

Recent internal combustion engines have an increased combustion temperature to provide high output and fuel consumption improvement. This causes an increased thermal stress in the central electrode of a spark plug. Accordingly, it is necessary to provide a spark plug having a highly reliable joint structure between the electrode base material part and the noble metal chip.

In order to achieve this requirement, another aspect of the present disclosure provides the spark plug having an improved structure in which the components of the noble metal chip in the primary measurement area in the first intermediate region have the first average ratio of not less than 48 wt %, In addition, the components of the noble metal chip in the secondary measurement area have the second average ratio of not more than 70 wt %. This improved structure makes it possible to suppress the composition of components between the noble metal chip and the primary measurement area from changing rapidly, and to suppress the composition of components between the secondary measurement area and the electrode base material part from changing rapidly. This improved structure makes it further possible to reduce a thermal stress from being generated in the central electrode during the use of the spark plug. This structure makes it possible to easily produce the central electrode of the spark plug with a reliable and stable joint between the electrode base material part and the noble metal chip.

R1 indicates the first average ratio of the components of the noble metal chip in the primary measurement area, and R2 indicates the second average ratio of the components of the noble metal chip in the secondary measurement area arranged at the electrode base material part side. A usual case satisfies a relationship of $1 \leq R1/R2$ because the primary measurement area is arranged at the noble metal chip side than the location of the secondary measurement area.

On the other hand, a case of $1 > R1/R2$ causes a nonuniform mixture of the components in the intermediate region. The inventor of the present disclosure has realized that the composition of components between the noble metal chip and the primary measurement area or between the secondary measurement area and the electrode base material part have changed rapidly, and cracking may easily grow. Further, the inventor of the present disclosure has recognized that a case of $R1/R2 > 1.4$ causes a speedy change of the composition of components between the primary measurement area and the secondary measurement area in the intermediate region. This case of $R1/R2 > 1.4$ easily causes cracking in the central electrode.

In order to avoid this, the central electrode of the spark plug according to another aspect of the present disclosure satisfies the relationship of $1 \leq R1/R2 \leq 1.4$. This improved structure makes it possible to suppress cracking from growing.

In the spark plug according to another aspect of the present disclosure, the primary measurement area is composed of a plurality of primary measurement square areas arranged on a cross section, which passes through a central axis line of the central electrode. Each of the plurality of primary measurement square areas has one side of 100 μm length. Two sides of each of the plurality of primary measurement square areas are arranged parallel with the central axis line of the central electrode. An end of each of the plurality of primary measurement square areas is in contact with a boundary between the noble metal chip and the intermediate region.

Similarly, the secondary measurement area is composed of a plurality of secondary measurement square areas arranged on the cross section parallel to the central axis line of the central electrode. Each of the plurality of secondary measurement square areas has one side of 100 μm length. Two sides of each of the plurality of secondary measurement square areas are arranged parallel with the central axis line of the central electrode. An end of each of the plurality of secondary measurement square areas is in contact with a boundary between the intermediate region and the electrode base material part.

In the improved structure of the central electrode in the spark plug according to the present disclosure, the primary measurement area is determined to be composed of the primary measurement square areas on a cross section which passes through the central axis line of the central electrode. Each primary measurement square area has the side of 100 μm. The edge, at the noble metal chip side, of the primary measurement square area is in contact with the boundary between the noble metal chip and the welded part when the two sides of the primary measurement square area are arranged parallel with the central axis line of the central electrode. This arrangement makes it possible to stably form the primary measurement area close to the boundary between the noble metal chip and the welded part. This makes it possible to improve the measurement accuracy to calculate the first average ratio R1 of the components of the noble metal chip around the boundary between the noble metal chip and the welded part. Similarly, this makes it possible to improve the measurement accuracy to calculate the second average ratio of the components of the noble metal chip around the boundary between the welded part and the electrode base material part. This makes it possible to provide the stable joint between the electrode base material part and the noble metal chip with high reliability.

In the spark plug according to another aspect of the present disclosure, the electrode base material part of a cylindrical shape has an equal-diameter part which is formed to be in contact with the intermediate region. The central electrode satisfies a relationship of $0.6 \leq D1/D2 \leq 0.9$, where D1 represents the outer diameter of the noble metal chip, and D2 indicates the outer diameter of the equal-diameter part.

In the structure of the spark plug, the electrode base material part has a cylindrical shape. The equal-diameter part is formed to be in contact with the intermediate region. This structure makes it possible to provide a fixed outer diameter of the electrode base material part at the intermediate region even if the position of the intermediate region varies along the axial direction of the noble metal chip. Further; this structure makes it possible to suppress the composition of the intermediate region from being changed. The spark plug according to the present disclosure satisfies a relationship of $0.6 \leq D1/D2 \leq 0.9$, where D1 represents the outer diameter of the noble metal chip, and D2 indicates the outer diameter of the equal-diameter part. This structure makes it possible to suppress the position of the electrode base material part and the position of the noble metal chip from being varied in the radial direction of the central electrode. Accordingly, this improved structure makes it possible to provide the central electrode of the spark plug having the stable first and second average ratios R1 and R2 of the components of the noble metal chip in the primary measurement area and the secondary measurement area.

In the spark plug according to another aspect of the present disclosure, the intermediate region has a first welded part and a second welded part. The second welded part is arranged separate from the noble metal chip side than a location of the first welded part.

In the laser welding method according to the present disclosure, the second welded part is formed at a location apart from the noble metal chip side from the first welded part by using the laser welding. This process performs the laser welding to form the intermediate region. The second welded part is formed to be overlapped with a part of the first welded part in the axial line of the noble metal chip after the first welded part is formed by the laser welding process. This structure of the central electrode produced by the method makes it possible to easily reduce the second average ratio of the components of the noble metal chip in the second welded part less than the first average ratio of the components of the noble metal chip in the first welded part. This structure of the central electrode produced by the method makes it possible to easily adjust the second average ratio of the components of the noble metal chip in the second welded part.

Specifically, according to another aspect of the present disclosure, the noble metal chip is made of an iridium (Ir) alloy, and the electrode base material part is made of a nickel (Ni) alloy.

In a method according to another aspect of the present disclosure, the intermediate region is formed between the electrode base material part and the noble metal chip by using a laser welding.

The components of the electrode base material part and the components of the noble metal chip are mixed in the intermediate region. The intermediate region has a primary measurement area and a secondary measurement area. The components of the noble metal chip in the primary measurement area in the intermediate region has the first average ratio of not less than 40 wt %. The components of the noble metal chip in the secondary measurement area has the second average ratio of not more than 80 wt %.

The method according to another aspect of the present disclosure uses the laser welding process of producing the intermediate region on the overall surface between the electrode base material part and the noble metal chip. The components of the electrode base material part and the components of the noble metal chip are mixed in the intermediate region formed between the electrode base material part and the noble metal chip. This makes it possible to easily melt the electrode base material part and the noble metal chip in depth, and to easily form the welded part on the overall surface between the electrode base material part and the noble metal chip. Further, this makes it possible to adjust a fused amount of the components of the electrode base material part and the noble metal chip with high accuracy. Accordingly, it is possible for the components of the noble metal chip in the primary measurement area to easily have the first average ratio of not less than 40 wt %, and for the components of the noble metal chip in the secondary measurement area to easily have the second average ratio of not more than 80 wt %.

The method according to another aspect of the present disclosure forms a first welded part and a second welded part in the intermediate region by using a laser welding process.

The second welded part is separate from the noble metal chip side as compared with the location of the first welded part.

This process makes it possible to produce the central electrode in the spark plug according to the present disclosure previously described.

Further, the method according to another aspect of the present disclosure uses a laser welding machine used to form the intermediate region. The laser welding machine has a lens in which a central part of the lens has a transmittance which is higher than a transmittance of a peripheral part of the lens.

The laser welding machine used by the method according to the present disclosure has the lens having the central part and the peripheral part. The central part has a first transmittance which is higher than a second transmittance of the peripheral part. The intermediate region as the welded part is composed of a first welded part as the first intermediate region, a second welded part as the second intermediate region, and a third welded part as a third intermediate region. The first welded part is formed by a laser light parallel to the central part of the lens. The second welded part and the third welded part are formed by a laser light parallel to the peripheral part of the lens. This process makes it possible to easily form the first welded part on the overall surface of the area between the electrode base material part and the noble metal chip in the central electrode. Further, this process makes it possible to easily and precisely adjust the first average ratio in the primary measurement area and the second average ratio in the secondary measurement area.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug comprising:

a central electrode comprising an electrode base material part and a noble metal chip having a cylindrical shape and being welded on the electrode base material part; and a ground electrode arranged facing a tip surface in an axial direction of the noble metal chip of the central electrode, a spark discharge being generated between the noble metal chip and the ground electrode, wherein an intermediate region is formed on the overall surface between the electrode base material part and the noble metal chip, in which components of the electrode base material part and components of the noble metal chip are mixed, and a primary measurement area is defined in the intermediate region to be in contact with a boundary between the noble metal chip and the intermediate region, and a secondary measurement area is formed in the intermediate region, the primary measurement area and the secondary measurement area being separated from each other as different areas with an intervening portion of the intermediate region therebetween, components of the noble metal chip in the primary measurement area in the intermediate region have a first average ratio of not less than 40 wt %, and components of the noble metal chip in the secondary measurement area have a second average ratio of not more than 80 wt %; and the first average ratio of the components of the noble metal chip in the primary measurement area and the second average ratio of the components of the noble metal chip in the secondary measurement area are different from a third average ratio of the component of the noble metal chip in the intervening portion.

2. The spark plug according to claim 1, wherein the components of the noble metal chip in the primary measurement area in the first intermediate region have the first average ratio of not less than 48 wt %, and the components of the noble metal chip in the secondary measurement area have the second average ratio of not more than 70 wt %.

3. The spark plug according to claim 1, wherein the primary measurement area and the secondary measurement area in the intermediate region satisfy a relationship of $1 \leq R1/R2 \leq 1.4$, in which R1 is the first average ratio and R2 is the second average ratio.

4. The spark plug according to claim 1, wherein the primary measurement area is composed of a plurality of primary measurement square areas arranged on a cross section parallel to a central axis line of the central electrode, each of the plurality of primary measurement square areas has one side of 100 μm in length, and two sides of each of the plurality of primary measurement square areas are arranged parallel with the central axis line of the central electrode, and an end of each of the plurality of primary measurement square areas is in contact with a boundary between the noble metal chip and the intermediate region, and the secondary measurement area is composed of a plurality of secondary measurement square areas arranged on the cross section parallel to the central axis line of the central electrode, each of the plurality of secondary measurement square areas has one side of 100 μm in length, and two sides of each of the plurality of secondary measurement square areas are arranged parallel with the central axis line of the central electrode, and an end of each of the plurality of secondary measurement square areas is in contact with a boundary between the intermediate region and the electrode base material part.

5. The spark plug according to claim 1, wherein the electrode base material part has a cylindrical shape, and comprises an equal-diameter part formed to be in contact with the intermediate region, and the central electrode satisfies a relationship of $0.6 \leq D1/D2 \leq 0.9$, where D1 represents the outer diameter of the noble metal chip, and D2 indicates the outer diameter of the equal-diameter part.

6. The spark plug according to claim 1, wherein the intermediate region comprises a first welded part and a second welded part which is arranged further from the noble metal chip side than a location of the first welded part is.

7. The spark plug according to claim 1, wherein the noble metal chip is made of an iridium alloy, and the electrode base material part is made of a nickel alloy.

* * * * *